United States Patent [19]

Freimuth et al.

[11] 4,171,933

[45] Oct. 23, 1979

[54] PUMPING MECHANISM

[75] Inventors: Gerhart W. Freimuth, Flemington; Jerold S. Weiner, Spotswood, both of N.J.

[73] Assignee: Gerhart Engineering & Machine Co., Somerville, N.J.

[21] Appl. No.: 876,843

[22] Filed: Feb. 10, 1978

Related U.S. Application Data

[62] Division of Ser. No. 712,054, Aug. 6, 1976, Pat. No. 4,108,221.

[51] Int. Cl.[2] ..... F04B 1/14

[52] U.S. Cl. ..... 417/269

[58] Field of Search ..... 417/269, 539, 248; 91/491, 498

[56] References Cited

U.S. PATENT DOCUMENTS

| | | | |
|---|---|---|---|
| 1,723,874 | 8/1929 | Lurge | 417/539 |
| 2,669,185 | 2/1954 | Tallis | 417/269 |
| 3,046,950 | 7/1962 | Smith | 91/491 |
| 3,976,400 | 8/1976 | Major | 417/248 |

*Primary Examiner*—William L. Freeh

*Attorney, Agent, or Firm*—Kenneth Watov

[57] ABSTRACT

A cam-controlled pumping mechanism operating a piston pump for drawing fluid into the pump during a charge cycle, and pushing the fluid out of the pump during a discharge cycle includes an adjustable crank lever mechanism for providing adjustment of the volume of fluid being pumped. The profile of the track for the cam of the cam-controlled pumping mechanism can be changed to program the exit velocity of the fluid in accordance with the viscosity of the fluid.

7 Claims, 9 Drawing Figures

FIG. 4
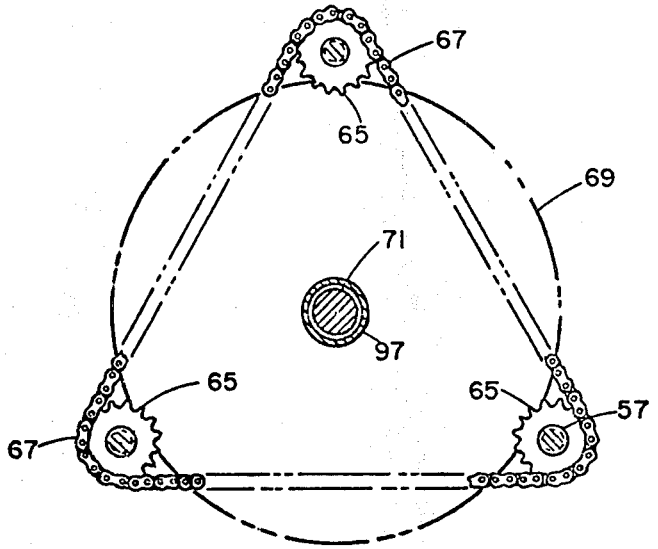
FIG. 5
A
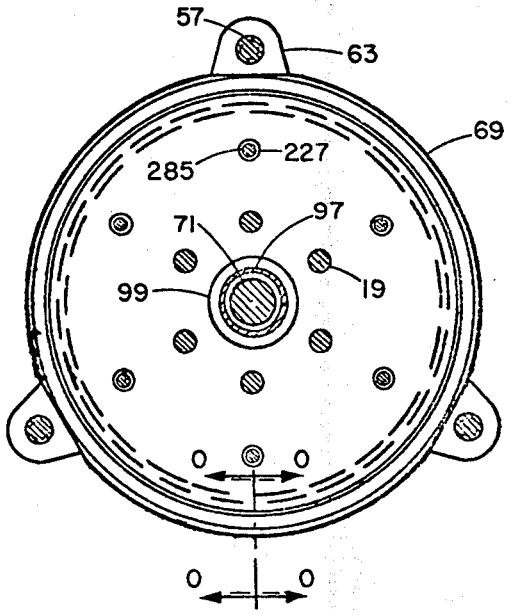
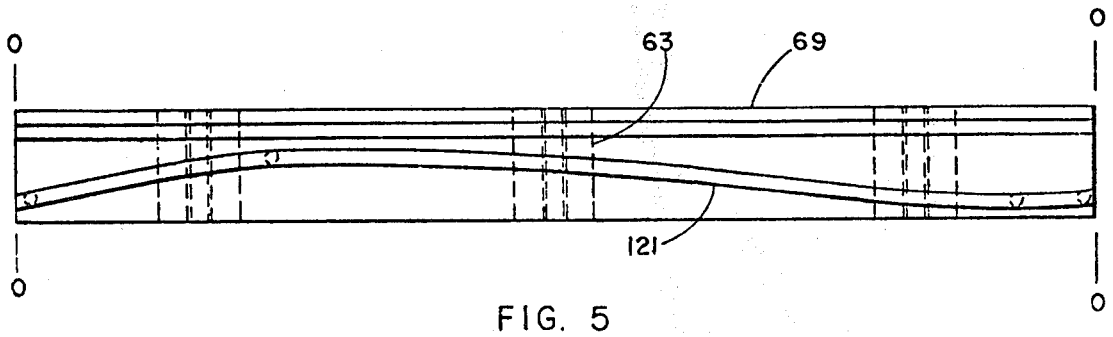
FIG. 5
B 105
91
71
97
103
99
93
101
95
109
145
143
147
149
141
139
151
137
135
129
125
127
123
121
131
133
63
57
69
165
167
171
169
19
107
161
163
159
155
153
157

PUMPING MECHANISM

This application is a divisional application from our U.S. Pat. No. 4,108,221, issued on Nov. 16, 1978, division of Ser. No. 712,054 filed Aug. 6, 1978 for Container Filling Machine.

This invention relates generally to pumping systems and more particularly to piston pump systems.

Modern filling machines for filling containers with a fluid must be capable of high-speed operation, while providing a multiplicity of other functions. For instance, in general the machines must discharge an accurate amount of fluid, repetitively into successive containers. It is desirable that provision be made for providing adjustment of the amount of fluid to be so discharged into each container from a piston-pump, for example.

The present inventive pumping mechanism provides in a container filling machine, for example, for individual or simultaneous adjustment of the volume of fluid discharged from each filling station into a container; and for programming the nozzle exit velocity to the fluid being discharged.

A detailed description of the invention as applied for use in a container filling machine, for example, is illustrated in the accompanying drawings, wherein like items are designated by the same numeral, in which:

FIG. 4 is a cross-sectional plan view along 4—4 showing the sprockets on upper portions of jackscrews interconnected by a chain;

FIG. 5 shows a top view (A) and a contour view (B) of the master or pump actuating cam;

Figure 1:
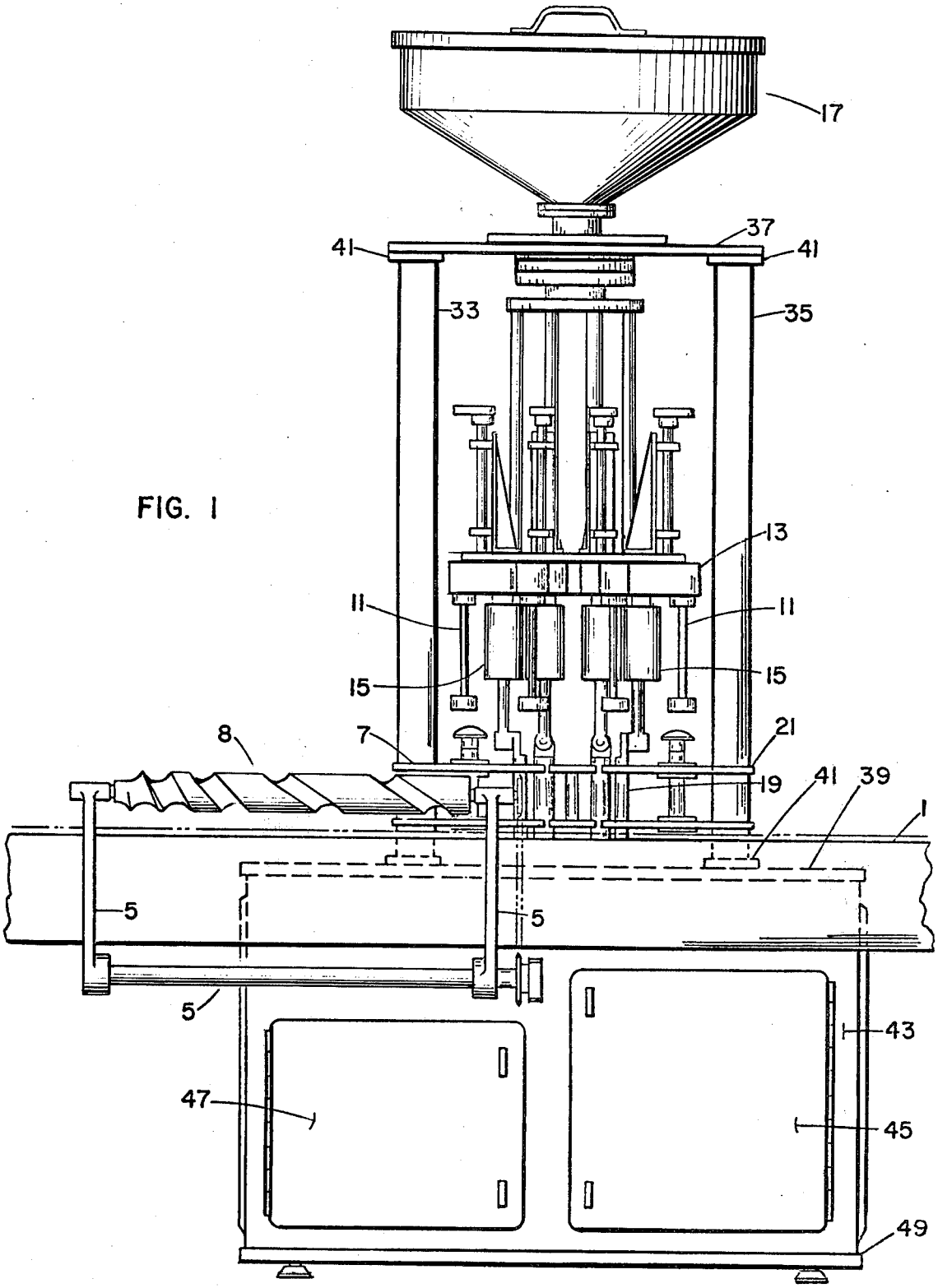
FIG. 1 is a front elevation view of the inventive container filling machine.
Figure 2:
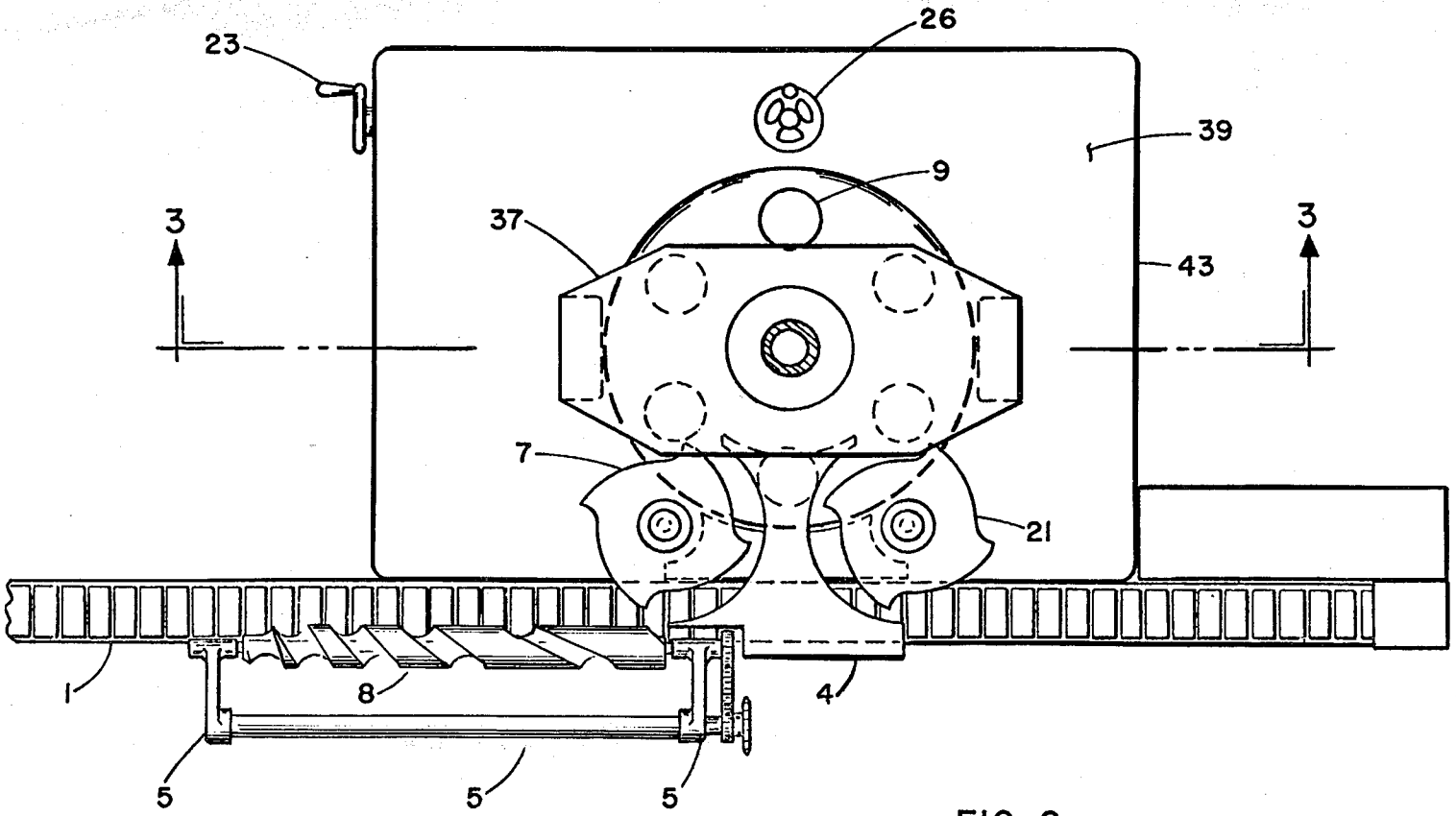
FIG. 2 is a plan view of the container filling machine.

The initial description is to present an over view of the filling machine incorporating the present invention, in this example. A more detailed description of the present invention and its operation will follow. A very detailed description of all mechanisms of the filling machine is given in our copending application as previously cited. In FIGS. 1 and 2, the container filling machine generally includes among other elements, a conveyor 1 driven in the direction of the arrows. Containers (not shown) to be filled with a fluid are placed on the conveyor 1 and moved toward the spacing screw 8 juxtapositioned to a portion of the length of the conveyor 1, as shown. Included with the spacing screw 8 is an assembly 5 providing for adjustment of, retention of, and quick removal of the spacing screw 8.

In normal operation, containers are moved into engagement with the revolving spacing screw 8, which separates and properly spaces the containers for properly timed entry into the filling portion of the machine. Once spaced, a container is engaged by the counterclockwise rotating infeed starwheel 7, appropriately positioned near the end of the spacing screw 8, and moved onto one of the container elevating platforms 9 (guiding is provided by centerguide 4). Six such platforms 9 are shown in this example, but a greater or lesser number can be provided. The platforms 9 are arranged in a circle and rotated in a clockwise direction. As the container is rotated away from the infeed starwheel 7, the associated platform 9 raises the container to a position where a filling nozzle 11 (there is one nozzle 11 located immediately above and rotating with each one of the platforms 9) is located within and proximate the inside surface of the bottom of the container. A mechanical sensing device detects the presence of a container upon the platform 9, and enables a filling valve 13 to be shifted from a closed position to a discharge position. At this time and thereafter for up to approximately 230° of machine cycle, cam controlled pumping of a piston 15 (or syringe) is initiated to deliver product or fluid to nozzle 11 for discharge into the container. As the fluid level rises in the container, the container elevating platform 9 is lowered at the same rate as the level of the fluid rises, maintaining the nozzle just above the surface of the fluid, to avoid turbulence and other problems, such as foaming, for example.

When the container is filled, a valve shifting mechanism closes the valve 13 to prevent further discharge from the nozzle 11, and opens the valve 13 to an intake or charging position. With valve 13 so positioned, fluid from the bulk supply tank 17 will be drawn into the syringe 15 on the downstroke of the associated piston rod 19. Of course, the upstroke cycle of the piston rod 19 is used to force fluid from the piston 15 into the associated nozzle 11, for filling a container. The platform 9 is lowered to the level of the conveyor 1, and the filled container is swept or moved by the counterclockwise rotating delivery starwheel 21 onto the conveyor 1. As the platform 9 and associated nozzle rotate to receive the next container, the chamber of the piston 15 or piston filling pump 15 is refilled to a given volume of fluid.

The speed of the machine operation can be adjusted via a speed control handwheel 23. To accommodate different container heights, the assembly including the nozzles 11, valves or valve bodies 13, pistons 15, pump actuating or piston rods 19, and so forth, can be vertically raised or lowered with respect to the container platforms 9 (and other machine elements) via the container height adjustment handwheel 26. Similarly, via the present invention, the length of the stroke of the piston rod 19 is adjustable for changing the volume of fluid to be discharged into the containers. The container height adjustments can be made while the machine is running.

Figure 3:
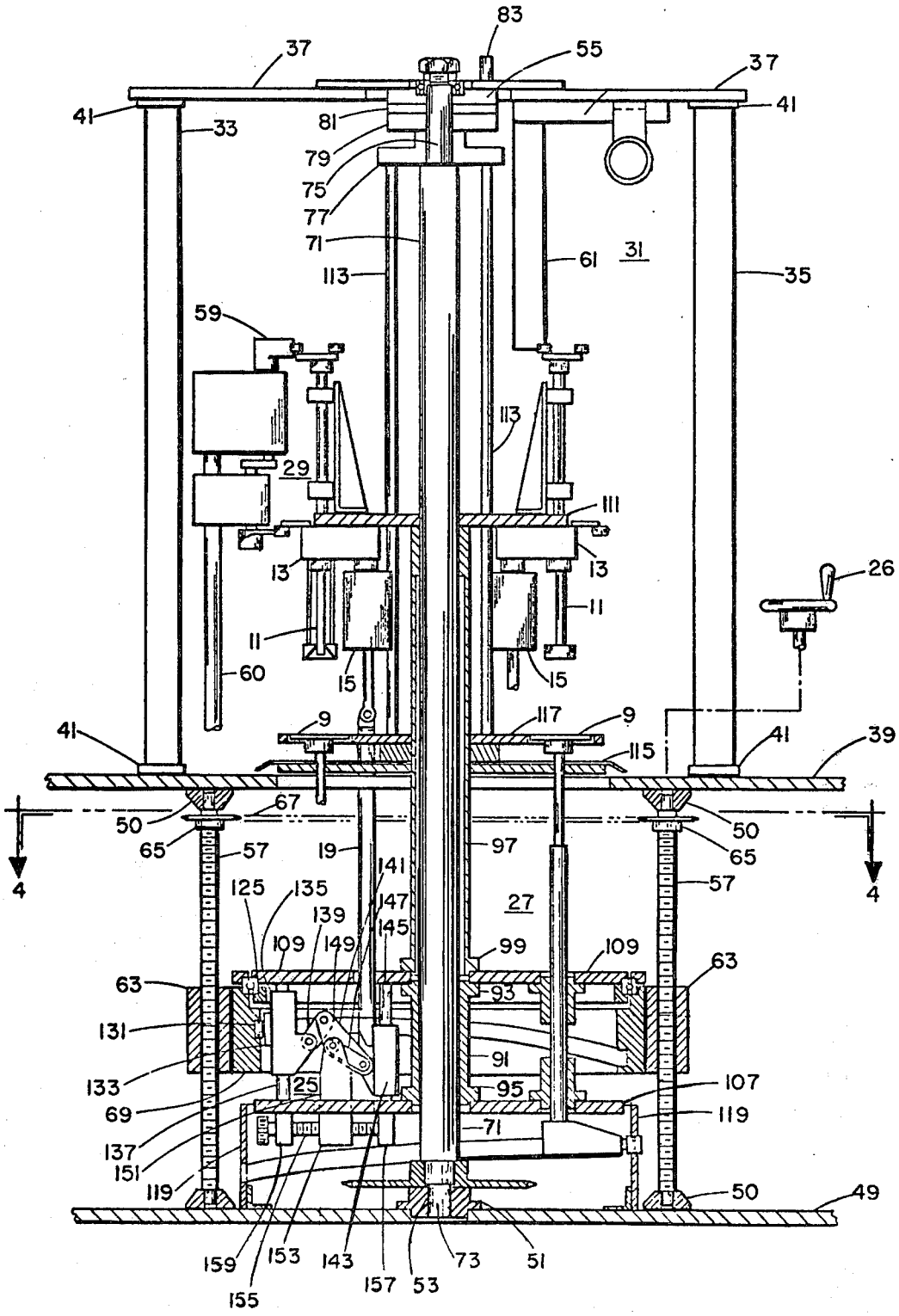
FIG. 3 is a cross-sectional elevation taken along 3—3.

In FIG. 3, a vertical sectional view of the filling machine shows partial detail views of a volume adjustment or stroke adjustment mechanism 25 for one piston pump 15, a container platform 9 elevating mechanism 27, and valve actuating mechanisms 29. Each one of the six filling stations, in this example, include such mechanisms. Also, with reference to FIGS. 1 and 2, the rigid and fixed frame-like members of this machine includes side or vertical columns 33 and 35, each rigidly connected at their uppermost ends to opposite ends of the bottom face of an upper horizontal support plate 37, and at their lowermost ends to opposite ends of the top face of a lower horizontal support plate 39. Anchor plates 41 are rigidly connected to the ends of the columns 33, 35 and bolted to the upper and lower horizontal support plates 37, 39. The lower horizontal support plate 39 forms the top of a cabinet 43 completely enclosing or serving as a housing for all mechanisms located below support plate 39. Access doors 45 and 47 are located on the front of the cabinet. The bottom of the cabinet is provided by a base plate 49. A lower seat and bearing 51 is rigidly attached to and located upon the top of the base plate 49. The top portion of the seat and bearing 51 is annular and has a centrally located circular recess 53. Also, a stationary plate 55 is centrally located upon the bottom of the upper support plate 37, and keyed to prevent rotation. Three individual jackscrews 57 are located vertically between the lower support and base plates 39 and 49, respectively, via bearings 50. The jackscrews 57 are evenly spaced along the circumference of a circle (every 120°), in this example. The ends of the jackscrews 57 are each seated within an individual one of the bearings 50, appropriately located and rigidly attached to the bottom and top faces of lower support and base plates 39, 49, respectively. A horizontally extending valve shift arm 59 is pivotally attached at one end to the upper end of a pair of vertical support rods 60. The lower ends of the vertical support rods 60 are rigidly attached to the nonrotating cam 69. Another valve shift arm 61 is movably attached at one end to the bottom of upper support plate 37, and extends vertically downward therefrom. The valve shift arms 59 and 61 extend into the circular path of travel of the valve actuating mechanisms 29 (six in this example) at outer and inner radial points, respectively, of this circular path. The shift arms 59 and 61 are so located to open and close, respectively, the valves 13 as associated valve actuating mechanisms 29 pass by.

A threaded bushing 63 is located on each one of the jackscrews 57 at a like distance from the base plate 49. A chain sprocket 65 is located on an uppermost portion of each one of the jackscrews 57 and rigidly attached thereto, a like distance from lower support plate 39. As shown in FIG. 4, a chain 67 interconnects the sprockets 65. With reference to FIGS. 3 and 5, a master barrel cam or pump actuating cam 69 is rigidly attached at points along its circumferential surface to the threaded bushings 63.

A rotatable center column 71 has a reduced lower end 73 seated in the circular recess 53 of the bearing 51. The lower drive sleeve 91, in conjunction with associated members 39, 49, 50, 57, 63, 69, 109, 125 provide the major support for center column 71. The drive sleeve 91 is slideably mounted upon center column 71. A hanger plate 77, is rigidly mounted over the reduced uppermost portion 75 of the center column 71, as shown. Sandwiched between the top of the reduced end of the hanger plate 77 and the stationary plate 55 are a rotatable plate 79, and a tetrafluoroethylane seal 81 located between the top of the rotatable plate 79 and the bottom of the stationary plate 55. The seal 81, rotatable plate 79, and hanger plate 77 are rigidly connected together by suitable means, forming a portion of a rotary union.

Figures 6, 7:
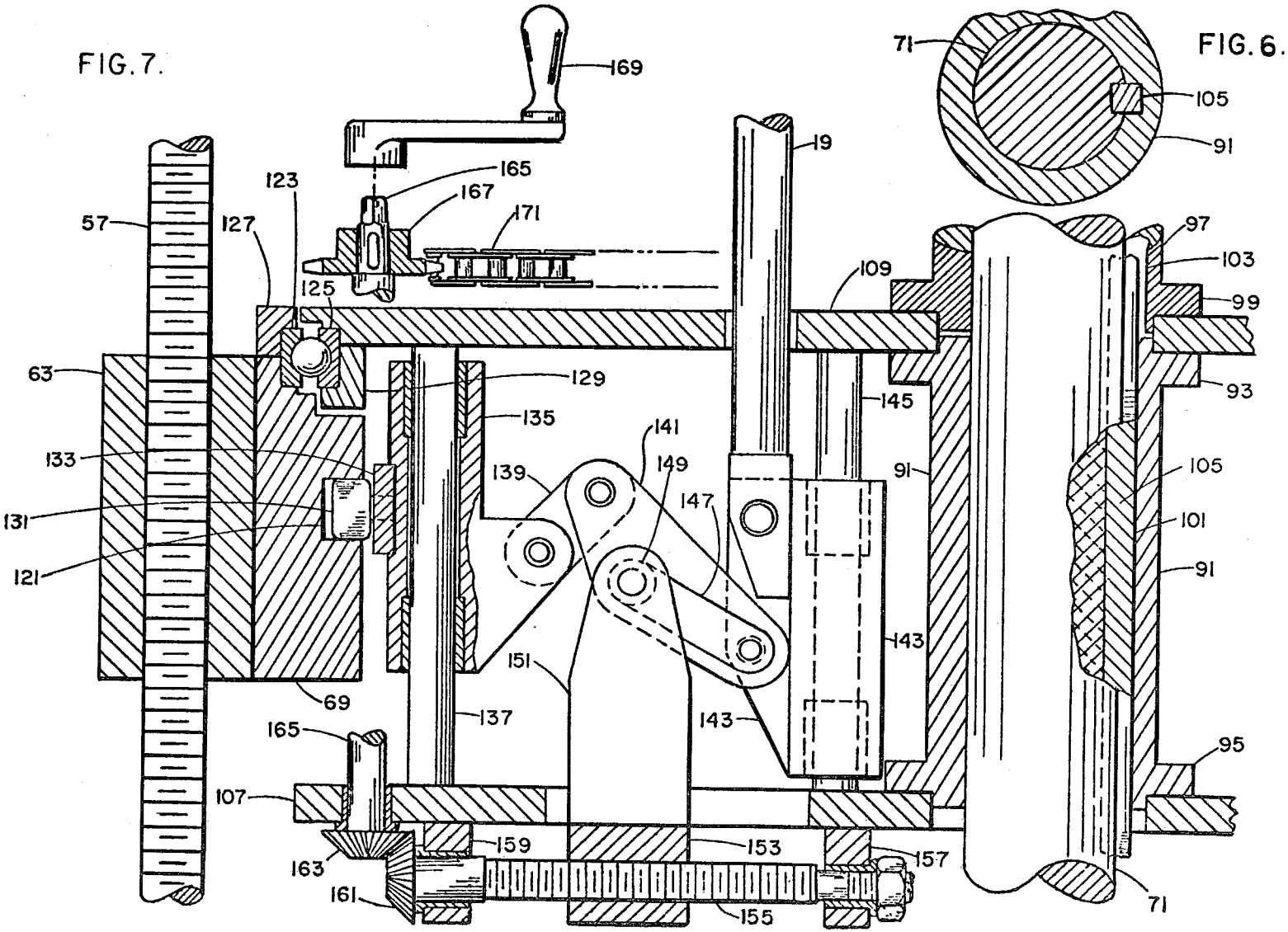
FIG. 6 is a top sectional view along line 7—7 of FIG. 8 showing location of drive key.
FIG. 7 is a partial cross-sectional elevation view of the volume adjustment mechanism.

A lower drive sleeve 91 is slideably mounted on the lower portion of the center column 71, and has upper and lower flanges 93, 95, respectively (see FIG. 7). An upper torque sleeve 97 having a lower flange 99 is slideably mounted upon the center column 71, directly above the lower drive sleeve 91. The lower drive sleeve 91 and upper torque sleeve 97 each have an axially running or longitudinal slot or keyway 101, 103, respectively, for engaging a key or spline 105 rigidly located upon the center column 71 (see FIGS. 3, 7 and 8). The keyways 101 and 103 engage the spline or key 105 in such manner that the lower drive sleeve 91 and upper torque sleeve 97 are locked to the center column 71 for common rotation, but are each free to move vertically upon the center column 71. This vertical movement is required in adjusting the machine for filling containers of different heights, from one filling run to another.

A circular lower rotary plate 107 has a centrally located hole for mounting upon and is rigidly connected to lower circular flange 95 of drive sleeve 91. An upper circular rotary plate 109 has a centrally located hole for mounting upon the upper end of the lower drive sleeve 91. This upper rotary plate 109 is rigidly connected to and between the upper flange 93 of the drive sleeve 91, and the bottom flange 99 of the torque sleeve 97. A valve mounting plate 111 having a centrally located hole through which the center column 71 protrudes, is rigidly mounted (bolted for example) to the top of the torque sleeve 97.

Rotational drive power is applied to the lower drive sleeve 91 by motive means, which are not shown. Such means may include a variable speed motor or a motor driven gear box connected via gear, chain and sprocket, or belt and pulley mechanisms to rotate the lower drive sleeve 91 and interconnecting mechanisms at a desired angular speed.

Vertical support rods 113, six in this example, are evenly spaced from one another and the center column 71, and are rigidly attached at one end to the bottom of the hanger plate 77 (see FIGS. 1 and 3). The support rods 113 are run through holes in the valve mounting plate 111, and rigidly attached at their other ends to a horizontally oriented circular drip shield 115. Holes through this shield 115 are appropriately located to permit free movement of the container elevating platforms 9, the pump actuating rod 19, and the center column 71. The drip shield 115 is located at a level just below the container platforms 9, and is used to help prevent spilled product or fluid from dripping into the mechanisms underneath. A circular transfer plate 117 having holes similarly located as the drip shield 115, is located in the same horizontal plane as the container elevating platforms 9 at rest. The transfer plate 117 is rigidly attached to the vertical support rods 113, and provides a pathway or slideway between the container elevating platforms 9 and the conveyor 1, thereby permitting the infeed starwheel 7 to move or slide a container from the conveyor 1 onto a container elevating platform 9 for filling, and the delivery starwheel 21 to move a filled container from its platform 9 back onto the conveyor 1.

A container elevating barrel cam 119 is located as shown in FIG. 3. This cam 119 is rigidly attached along its bottom circumference to the top of the base plate 49.

The major framework, structural members, and certain portions of operating assemblies have now been described in greater or lesser detail. A detailed description of the present inventive cam controlled pumping mechanism will now be given.

Figure 8:
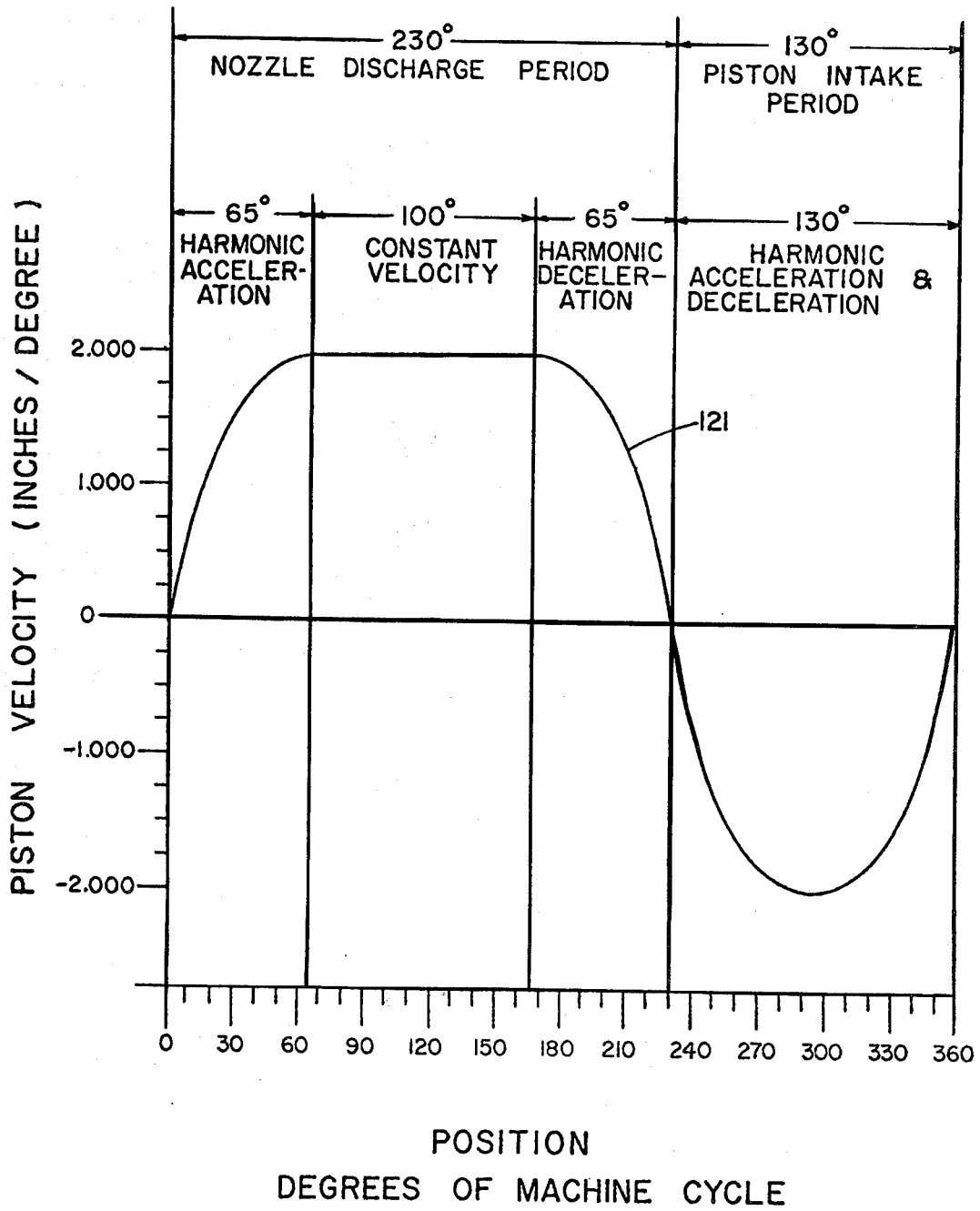
FIG. 8 is a diagram of the exit flow velocity curve for the velocity of fluid exiting from the nozzles, for a preferred embodiment.

The cam controlled pumping and volume (stroke) adjustment mechanisms 25, with reference to FIGS. 3, 5 and 7, includes the master cam or pump actuating barrel cam 69 having an internally milled groove, track, or camway 121. This groove 121 is dynamically profiled, as shown in FIG. 8, the significance of which will be explained later. The pumping cam 69 is held in a fixed angular position by the bushings 63 mounted upon the jackscrews 57. The upper portion of the master cam 69 has a recess 123, for housing or retaining an angular contact rotary bearing 125. Upper and lower bearing retainers 127, 129 are located, as shown, for retaining the rotary bearing 125 in the recesses 123 of the cam 69. A cam follower 131 rides in the groove 121 of cam 69, and is rigidly attached to a cam follower bracket 133. The cam follower bracket 133 is in turn rigidly mounted upon a cam slide 135. The cam slide 135 is slideably mounted upon a vertical slide shaft 137 rigidly connected between the upper and lower rotary plates 109, 107. The cam follower bracket 133 is guided to prevent rotation around the slide shaft 137. A protruding arm of the cam slide 135 is connected by a movable link 139 to one upper corner of a substantially triangular crank lever 141. The opposing upper corner of the crank lever 141 is rotatably mounted or pinned to a protruding arm of a pump slide 143. The pump slide 143 is slideably mounted upon a vertical slide shaft 145 rigidly connected between lower and upper rotary plates 107, 109 adjacent drive sleeve 91. The top of the protruding arm of the pump slide 143 is rigidly connected to the lower end of the pump actuating rod 19. A slot 147 of crank lever 141 is connected via a roller 149 to the upper end of a pivot bracket 151, extending upward through a hole in and from below the lower rotary plate 107. The lower end of the pivot bracket 151 is rigidly attached to the top of an adjuster block 153. The adjuster block 153 is internally threaded for mounting and movement upon a stroke adjusting lead screw 155.

One end of the stroke adjusting screw 155 is retained by a bearing 157 rigidly mounted to the bottom of the lower rotary plate 107 near the center column 71. The other end of the adjusting screw 155 protrudes through and is retained by another bearing 159 rigidly mounted to the bottom of the lower rotary plate 107. A bevel gear 161 is rigidly mounted upon the protruding end of the stroke adjusting screw 155. This bevel gear 161 is mated to or intermeshed with another bevel gear 163 rigidly mounted upon the end of a stroke adjusting drive shaft 165, protruding through a hole in the lower rotary plate 107 from above. The other end of the stroke adjusting drive shaft 165 protrudes through a hole in the upper rotary plate 109 from below, and has a sprocket 167 rigidly mounted upon it. The top of the sprocket 167 is adapted for connection to a hand crank 169 or motor driven pulley (not shown). Each one of the six filling stations (more or less can be provided) include a cam controlled pumping and volume or stroke adjustment assembly 25, as described. A chain 171 is wrapped around all of the sprockets 167 of the mechanisms 25, thereby permitting simultaneous adjustment of the stroke length of the associated pump actuating rods 19, by turning a sprocket 167 of any one of the mechanisms 25. The upper end of the pump actuating rod 19 is connected to a piston head of a piston pump 15. The longer the stroke, the greater the volume of fluid pumped. The valve 13 is connected to the upper portion of pump 15.

It should be noted that the rotary bearing 125, not only supports the upper rotary plate 109, but also supports all other of the rotating members or structure above and below the upper rotary plate 109. This bearing 125 encircles the bottom or the upper rotary plate 109. In other words, the rotary bearing 125 supports the lower drive sleeve 91, upper torque sleeve 97, and all rotating members directly or indirectly rigidly or captively connected to these sleeves 91 and 97.

In operation, the rotating center column 71 provides rotation of the cam controlled pumping and volume (stroke) adjustment assembly 25, causing the cam follower 131 to follow the groove or track 121 of the master barrel cam 69. In turn, the motion imparted to the cam follower 131 causes the cam slide 135 to move vertically up and down, in accordance with the dynamically profiled track 121 of cam 69 analogous to FIG. 8. Note that 0° represents the initiation of container filling, where fluid begins to enter a container. As cam slide 135 moves up and down, it causes (via link 139) crank lever 141 to pivot about roller 149 of the pivot bracket 151. As will be explained in detail later, the relative degree of pivoting of the crank lever 141, for a given vertical movement of cam slide 135, is controlled by the positioning of adjuster block 153. The relative pivotal movement of the crank lever causes the pump slide 143 to move up and down, in turn causing the pump actuating rod 19 to likewise move up and down. Upward movement is imparted to pump rod 19 during a discharge cycle, for forcing fluid from the piston chamber 15, through valve 13, and into a nozzle 11 for discharge into a container. Downward movement is imparted to pump rod 19 during a charge cycle, for drawing fluid into the piston chamber 15, from the valve 13. Fluid is delivered to the valves 13 from the bulk supply 17, via the rotary union assembly 77, 79, 81.

As previously mentioned, the cam 69 includes a dynamically profiled track 121. This track 121 is profiled for providing a relatively constant and controlled exit velocity of fluid from the nozzles 11, throughout a substantial portion of the 230° discharge cycle, as shown in FIG. 9. Similarly, such a profile can provide a relatively constant rate of charging of the pistons 15 throughout a substantial portion of the 130° of charge cycle. In comparison to some machines of the prior art employing a sinusoidal track, for providing simple harmonic motion to the pumps, a relatively higher maximum exit velocity can be attained by such machines. However, the dynamically profiled track 121 provides a lower overall or average velocity over the 180° discharge cycle of the prior art machine. The profile of the track 121 (see FIG. 5B) can be changed to program or tailor the exit velocity of fluid from a nozzle, to the viscosity of the fluid being discharged. Also, the present filling machine extends the discharge cycle to about 230°. Since machine speed is dependent upon the exit velocity of fluid from a nozzle over a given period of time or machine cycle, the present machine is capable of running at higher speeds than such prior art machines.

The volume of fluid to be pumped from a particular pump 15 is adjustable by controlling the length of the stroke imparted to the pump actuating rod 19 by the pump slide 143. This is accomplished in one of two ways. The length of the stroke for the pump actuating rods 19 of each one of the pumping assemblies 25 (there are six in this example) can be adjusted or changed in unison by hand cranking or motor driving a sprocket 167 of any one of pumping assemblies 25. The chain 171 interconnecting the other sprockets 167 with the sprocket 167 being turned will cause all of the sprockets to be turned a like amount. As a sprocket 167 is so turned, its associated stroke adjusting screw 155 will be rotated via the drive shaft 165 and bevel gears 163 and 161, in a direction to move the adjuster block 153 to a new position. For example, an adjuster block 153 is moved further away from center column 71, to lengthen the fulcrum point of crank lever 141, to increase the stroke length of pump rod 19 for a given vertical movement of cam slide 135. Contrarywise, the adjuster block 153 is moved toward the center column 71 to shorten the fulcrum point of crank lever 141, for decreasing the stroke length of pump rod 19. The fulcrum point is of course dependent upon the position of the roller 149 within the slot 147 of crank lever 141. Each one of the pumping assemblies 25 can be trimmed or adjusted individually by removing a cap screw (not shown) to free the associated sprocket 167 from its drive shaft 165. The drive shaft 165 can now be turned to move the adjuster block 153 to a position for obtaining a desired stroke length for the associated pump rod 19, without affecting the other pump assemblies 25. Also, in this manner, the pump assemblies 25 may be adjusted for different volumes, for the same height containers, where each pumping assembly 25 is associated with nozzles 11 of equal length; or if different lengths of nozzles 11 are used between pumping assemblies 25, a mix of containers having different volumes and heights can be filled.

It should be noted that the piston pump 15 can be any one of a number of known designs. A piston pump that is ideally suited for use in this inventive filling machine is as described and claimed in our patent for PISTON PUMP MECHANISM, U.S. Pat. No. 4,020,750, issued on May 3, 1977.

What is claimed is:

1. In a pumping system, the combination comprising:
upper and lower rotary plates;
first and second slide shafts rigidly mounted between and providing separation of said upper and lower rotary plates;
a cam slide and a pump slide being slideably mounted upon said first and second slide shafts, respectively;
a pump actuating rod connected to an upper portion of said pump slide, and extending vertically therefrom through a hole in said upper rotary plate;
a crank lever having a first point pivotally connected to said pump slide, a slot running from a second point toward said first point connected to said pump slide, and a third point pivotally linked to said cam slide;
slideable pivot means mounted within said slot for providing a fulcrum point;
a pivot bracket having an upper end attached via said pivot means to a position along the slot of said crank lever, for maintaining a fulcrum point for said crank lever, and a lower end;
means attached to the lower end of said pivot bracket, for connecting said bracket to said lower rotary plate, and for permitting the selective positioning of the point of attachment of said bracket in said slot of said crank lever, for adjusting the length of stroke imparted to said pump actuating rod; and
means for moving said cam slide upon said first slide shaft in a predetermined manner.

2. The pumping system of claim 1, wherein said means permitting the selective positioning of said pivot bracket attachment in slot of said crank lever includes:
a stroke adjusting screw having two ends;
an adjuster block rigidly attached at a side to the lower end of said pivot bracket, said screw being threadably mated to and through said adjuster block; and
first and second bearings rigidly mounted upon said lower rotary plate, said screw carrying said adjuster block being mounted between said first and second bearings for turning therein, with one end of said screw protruding from said first bearing, this protruding end of said screw being turned for positioning said adjuster block upon said screw.

3. A system for pumping fluid including a plurality of piston pumps each having a piston to which a piston rod is connected, and cam controlled pumping means for operating said piston pumps, comprising:
a barrel-like pump actuating cam having a track, said track having a profile, for providing a relatively constant exit velocity of fluid from said piston pumps, during a discharge cycle, wherein the exit velocity is programmable, for different viscosities of fluids, via changes in the profile of said track;
cam follower means resting partially within and guided by said track, for providing pumping movement to the piston rods of said piston pumps, in correspondence with the profile of said track; and
means for providing individual adjustment of the stroke of each one of said piston pumps.

4. The fluid pumping system of claim 3, further including means for providing simultaneous adjustment of the stroke of each one of said piston pumps.

5. The fluid pumping system of claim 3, wherein said cam follower means includes:
a rotatable center column;
an upper rotary plate mounted between said center column and an uppermost portion of said cam;
a lower rotary plate mounted upon said center column below said upper rotary plate;
a plurality of first and second slide shafts mounted between said upper and lower rotary plates, and juxtaposed to said cam and column, respectively, each one of said first and second slide shafts being associated with a particular one of said piston pumps;
a plurality of cam slides, each one of which is mounted upon an individual one of said first slide shafts, for vertical movement thereupon;
a plurality of cam followers rigidly mounted one upon each cam slide, each cam follower having a free end protruding into and guided by said track of said cam;
a plurality of pump slides, each one of which is mounted for vertical movement upon an individual one of said second slide shafts, and rigidly connected to a lower end of an individual one of said piston rods;
a plurality of pivotal connection means;
a plurality of crank levers, each one of which is pivotally connected via an individual one of said plurality of pivotal connection means between individual opposing ones of said cam and pump slides, and each one of which contains a slot therein;
a plurality of pivotal attaching means;
a plurality of coupling means; and
a plurality of pivot brackets, each one having an upper end pivotally attached via an individual one of said plurality of pivotal attaching means to a position within the slot of an individual one of said crank levers, and a lower end adjustably coupled via an individual one of said plurality of coupling means to said lower rotary plate.

6. The fluid pumping system of claim 5, wherein said means for providing individual adjustment of the stroke of each one of said piston pumps includes:
a plurality of adjuster blocks, each one of which is rigidly mounted to the lower end of an individual one of said pivot brackets beneath an opening in said lower rotary plate;

a plurality of stroke adjusting screws, each one of which is threadably mated to and through an individual one of said adjuster blocks;

means for turning each one of said plurality of stroke adjusting screws; and a plurality of pairs of bearing means rigidly attached to said lower rotary plate, individual ones of said screws being retained by one of said pairs of bearings, with one end of said screws protruding through its respective bearing means for individual connection to said turning means, and when said protruding end is turned by said turning means, its associated adjuster block moves along said screw for positioning the upper end of said pivot bracket in the slot of said crank lever, for changing the stroke of the associated piston pump.

7. The fluid pumping system of claim 6, wherein said means for providing simultaneous adjustment of the stroke of each one of said piston pumps includes:

chain and sprocket means carried by said upper and lower rotary plates, and interconnecting the protruding ends of said stroke adjusting screws, for simultaneously turning said screws in the same direction and to the same degree.

* * * * *